US005845350A

United States Patent [19]

Beemiller et al.

[11] Patent Number: 5,845,350

[45] Date of Patent: Dec. 8, 1998

[54] CRADLE MATTRESS

[75] Inventors: Gerald V. Beemiller, Sunol; John W. Jamieson, Alamo; Richard D. Propper, Danville, all of Calif.; Dean L. Kamen, Bedford, N.H.; Jeffrey I. Finkelstein, North Ferrisberg, Vt.; Dennis C. Waite, Manchester, N.H.

[73] Assignee: Infant Advantage, Inc., San Ramon, Calif.

[21] Appl. No.: 602,277

[22] Filed: Feb. 16, 1996

[51] Int. Cl.[6] ..... A47D 9/02

[52] U.S. Cl. ..... 5/109; 5/915; 601/86; 601/90

[58] Field of Search ..... 5/108, 109, 915; 600/26; 601/49, 50, 51, 53, 54, 86, 90, 98

[56] References Cited

U.S. PATENT DOCUMENTS

| | | | |
|---|---|---|---|
| 2,794,190 | 6/1957 | Kellenbarger | 5/103 |
| 2,869,145 | 1/1959 | Gregory | 5/109 |
| 2,908,271 | 10/1959 | Ware | 601/50 |
| 3,043,293 | 7/1962 | Rider | 601/98 X |
| 3,453,999 | 7/1969 | Neal | 5/109 X |
| 3,809,065 | 5/1974 | Gatts | 128/1 R |
| 3,993,042 | 11/1976 | Gatts | 128/1 B |
| 4,066,072 | 1/1978 | Cummins | 128/40 |
| 4,079,728 | 3/1978 | Gatts | 128/1 B |
| 4,346,486 | 8/1982 | Keller | 5/447 |
| 4,934,997 | 6/1990 | Skakas | 5/108 X |
| 4,947,832 | 8/1990 | Blitzer | 128/33 |
| 4,969,451 | 11/1990 | Totten | 128/33 |
| 5,010,608 | 4/1991 | Barnett et al. | 5/453 |
| 5,037,375 | 8/1991 | Gatts | 600/21 |
| 5,063,912 | 11/1991 | Hughes | 128/33 |
| 5,107,555 | 4/1992 | Thrasher | 5/109 |
| 5,183,457 | 2/1993 | Gatts et al. | 600/21 |
| 5,385,153 | 1/1995 | Jamieson et al. | 128/845 |
| 5,398,353 | 3/1995 | Sachathamakul | 5/109 |

*Primary Examiner*—Michael F. Trettel
*Attorney, Agent, or Firm*—Fenwick & West LLP

[57] ABSTRACT

An infant environmental transition system provides an infant with controlled simulated movements encountered by an infant in an intrauterine environment. The system includes a suspension system having a plurality of flexures coupled between a base plate and a moving mattress platform. A cam shaft assembly includes a groove that engages a linear follower connected to the moving platform so that the follower moves along the groove while the cam shaft assembly rotates to move the linear follower, and thereby reciprocate the moving mattress platform in a longitudinal direction. Alternatively, a rotating crank assembly translates crank rotation to reciprocating movement of the mattress platform. The cam shaft assembly also includes an eccentric cam coupled to a rocker that is coupled to one of the flexures to angularly displace the moving mattress platform supported on the flexures, and thereby to provide the composite reciprocating and rotational movements of the moving mattress platform that simulate the intrauterine environment.

28 Claims, 16 Drawing Sheets

CRADLE MATTRESS

FIELD OF THE INVENTION

This invention relates to infant mattresses, and more particularly to infant mattresses that simulate stimuli, including motion and sound, experienced by an infant in an intrauterine environment.

BACKGROUND OF THE INVENTION

Animals have the ability to adapt to many and varied environmental conditions. The limit of adaptation depends mainly on the animal's absolute physiological limitations and the rate of environmental change or adaptive pressure to which it is subjected.

Perhaps the most difficult transition a mammal is required to make in its lifetime is the change from the intrauterine environment to the extrauterine environment at birth. Every parameter of the infant's environment changes abruptly. Dramatic shifts in temperature, tactile sensation, audio stimuli, motion, and light are exacerbated by conditions in the hospital delivery room where most women in modern societies give birth. Even the environment in a loving home is alarmingly unfamiliar, and many infants exhibit prolonged crying and sleeplessness which may be related to transitional stress. It is believed that these abrupt changes in the environment tend to intensify the infant's intrauterine to extrauterine transition and may inflict harm which affects the person's emotional and physical response to adaptive or environmental change throughout the remainder of his or her life. Therefore a gradual and effective transition of the infant from the intrauterine environment to the extrauterine environment may have substantial long-term as well as short-term benefits.

An effective transition system would duplicate as closely as conveniently possible the intrauterine conditions perceived by the infant just prior to birth. It would also provide means for gradually altering environmental stimuli over time until they reflect the natural extrauterine environment.

The environmental stimuli vary in complexity and ease of simulation or control. The motion parameter is quite distinctive. FIG. 1 shows the characteristic pelvic displacement patterns of pregnant women while walking. Duplicating the linear and rotational components of these motions is difficult and requires a sophisticated suspension and motion control and drive system.

U.S. Pat. No. 4,079,728 discloses a programmable environmental transition system that provides and controls a number of environmental stimuli and modifies them over time from initial values closely approximating what the fetus perceives in the uterus just prior to birth to final values typical of the extrauterine environment. Rather than duplicate any particular motion pattern, the system imparts a general rocking motion to the infant, who is suspended therein on a net-like sling.

U.S. Pat. No. 5,037,375 discloses an infant environmental transition system and method that provides a controlled transition from an intrauterine environment to an extrauterine environment. This system includes a motor assembly within the housing below the cradle. A pulley assembly driven by a belt drives shafts within the housing to impart movement to a cradle.

It is desired to have a motion system that is sufficiently small in size and in height to fit into conventional cribs and mattresses.

SUMMARY OF THE INVENTION

The present invention incorporates a motion-oriented environment within a mattress and includes a suspension and motion control and drive system which very closely replicates the intrauterine motion the fetus experiences as the mother is walking. Microprocessor based electronics integrate desired changes in motion and other stimuli to gradually transition the infant from the simulated intrauterine environment to the extrauterine environment, and to provide wide ranging system flexibility.

Previous suspension systems had undesirable complexity of the motion mechanism and could produce unacceptable levels of noise.

The present system overcomes these significant deficiencies and produces motion which is quiet, smooth and continuous with high safety and reliability and low maintenance. The electric motor and control electronics are housed within the control module separately from the mattress supporting the occupant. The motion drive system within the mattress has holonomic coupling between components. Holonomic coupling provides unique determinable movement of one component in response to movement of another component. The mattress is of conventional size and is easy to move.

DETAILED DESCRIPTION OF THE PREFERRED EMBODIMENT

Referring now to FIGS. 2–8, there is illustrated an environmental transition system including suspension and motion control and drive systems, and including a stimulus integration and modulation system, according to the present invention. The system provides for a gradual, controlled transition for the occupant by initially simulating its intrauterine environment and gradually transitioning to the extrauterine or everyday environment, thereby reducing adaptive shock and permitting healthy, gradual adaptation. This transition is accomplished by the present system which initially reproduces environmental motions regularly sensed by an infant prior to birth. In particular, the system provides and transmits to the occupant, via the suspension and motion control and drive systems, a motion which a fetus experiences as the mother is walking. The system is controlled to vary the motion in a day-night cycle and to reduce stimuli over time until the occupant is exposed to minimal motion which approximates the everyday environment.

Figure 1:
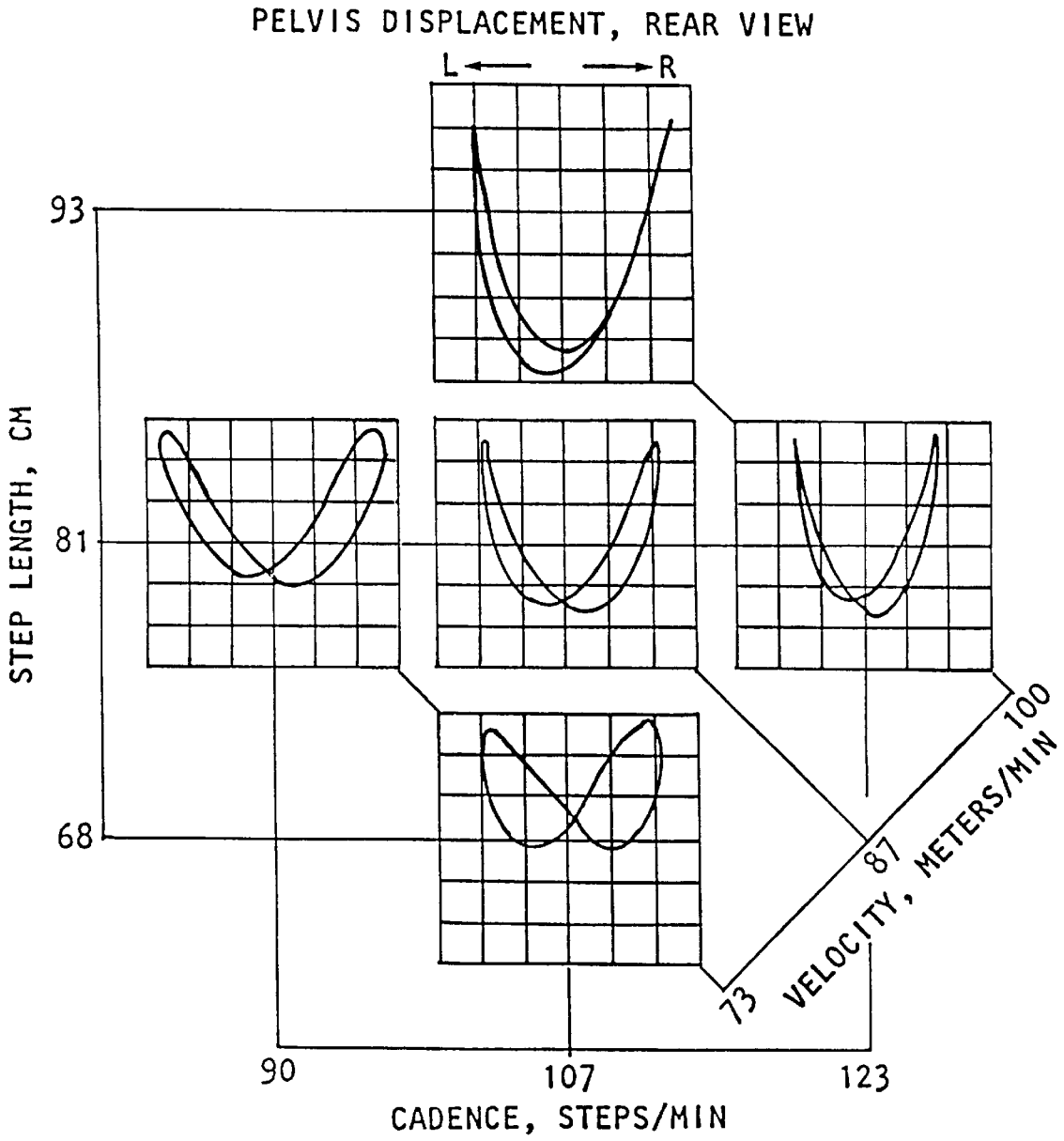
FIG. 1 is a graph showing the characteristic pelvic motion patterns of pregnant women while walking, which patterns are emulated by the motion parameters of the present invention.
Figure 2A:
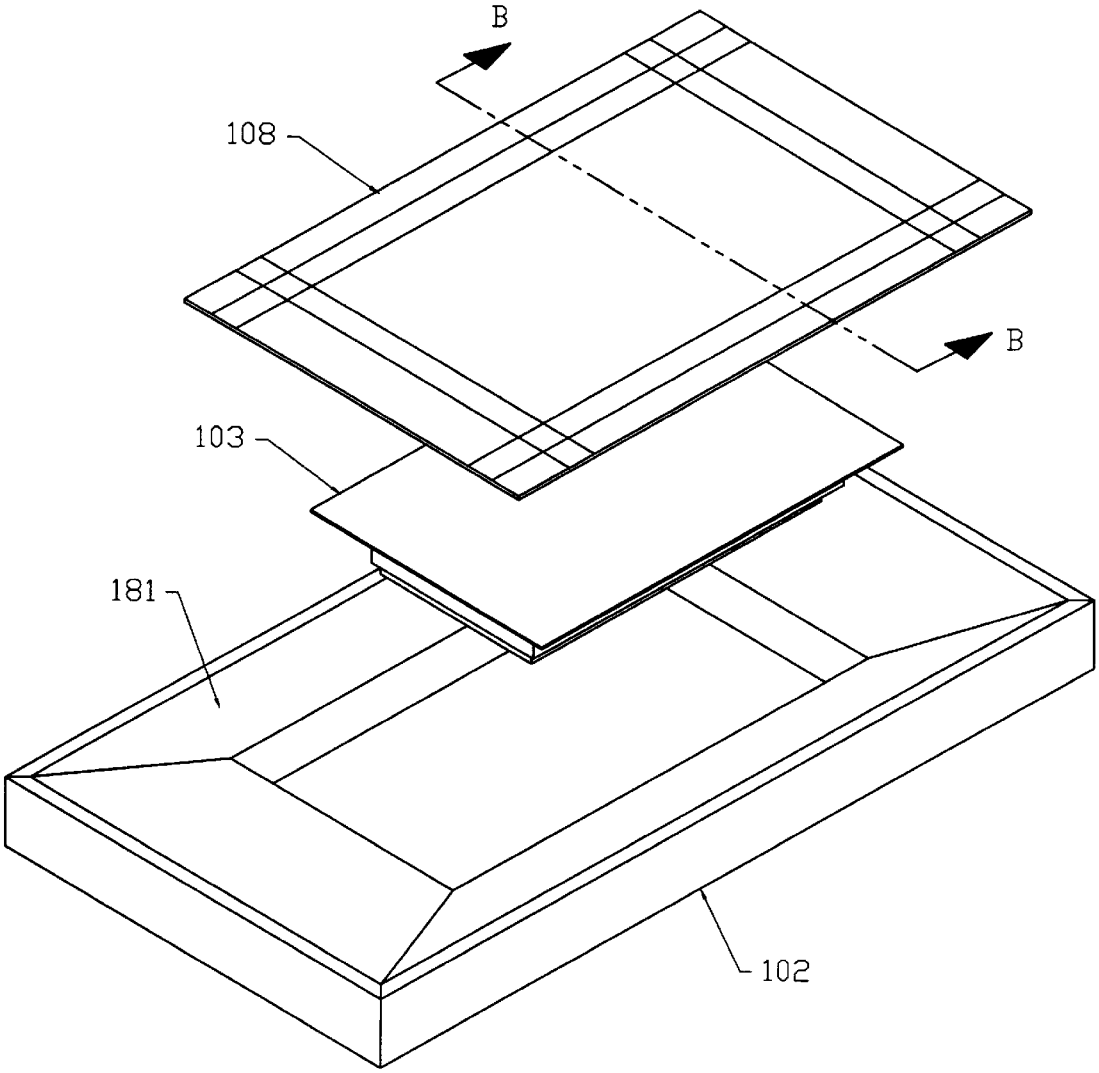
FIG. 2*a* is a perspective view of a mattress and of the subsystems housed within the mattress of an environmental transition system of the present invention.
Figure 2B:
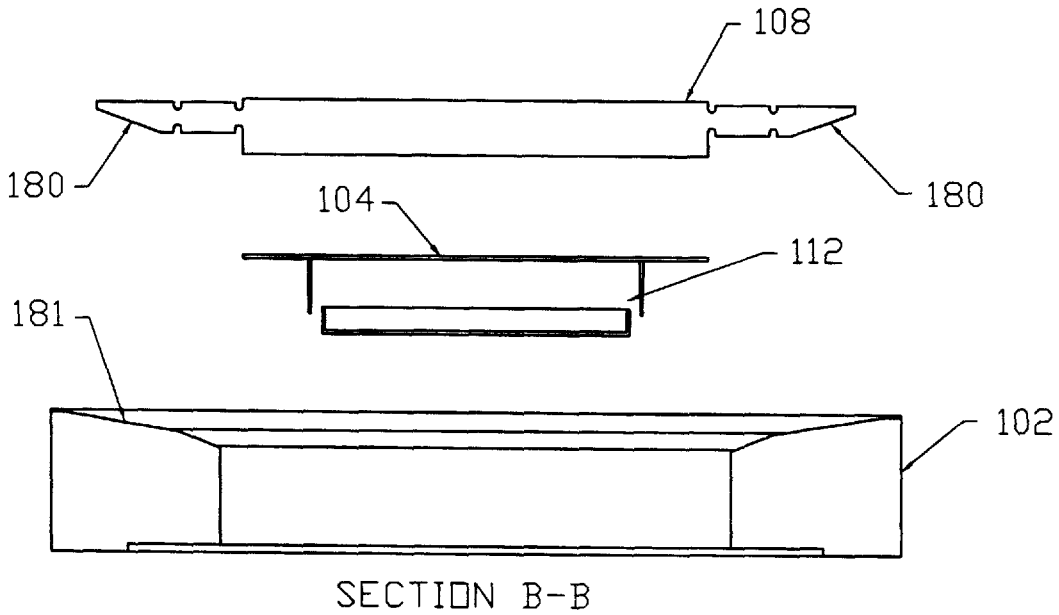
FIG. 2*b* is a cross-sectional view of the mattress and of the subsystems along a line 2*b*—2*b* of FIG. 2*a*.

Referring specifically to FIGS. 2*a* and 2*b*, the system includes a mattress 102 having a box-like shape and having thick sidewalls and bottom surface that are stationary and firm. The sidewalls house, support, and constrain a motion mechanism 103. A motion platform 104 is on the top surface of the mattress 102 and is supported for motion along several axes by a suspension system including flexures 106 (see FIG. 3). The mattress 102 includes a soft, form fitting mattress 108 having a bottom surface affixed to the top surface of the motion platform 104 and having a top surface for supporting the occupant.

Figure 3A:
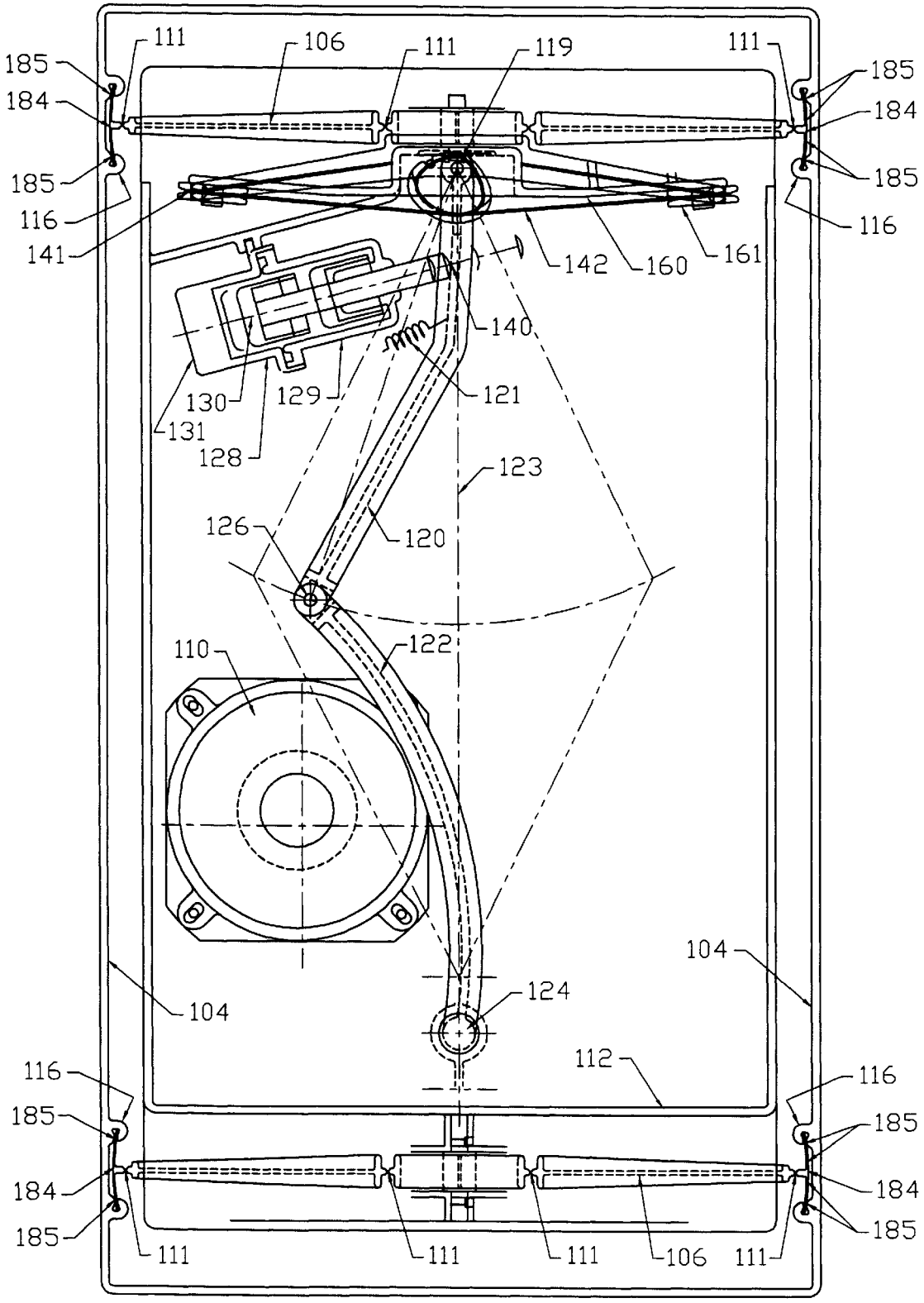
FIG. 3*a* is a top cutaway view of the mattress and the subsystems within the mattress.
Figure 3B:
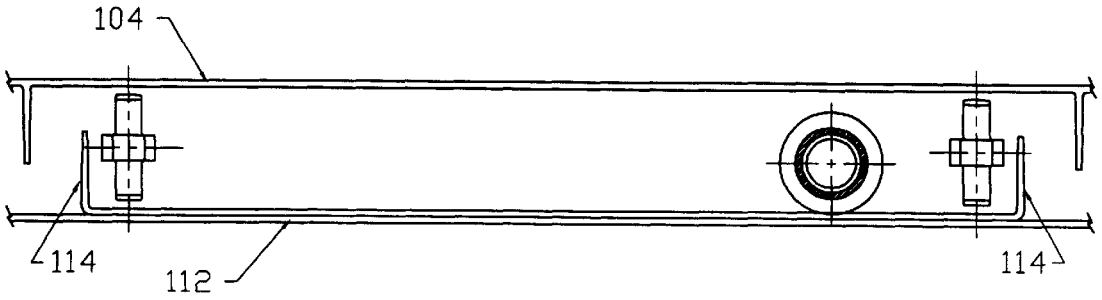
FIG. 3*b* is a cross-sectional view along a longitudinal axis of the mattress and the subsystems within the mattress.
Figure 3C:
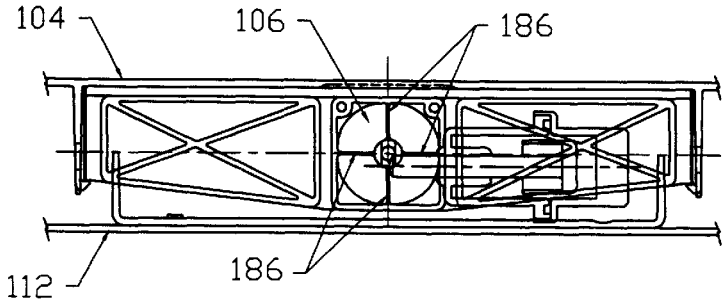
FIG. 3*c* is a cross-sectional view along a transverse axis of the mattress and the subsystems within the mattress.

Referring specifically to FIGS. 3*a*, 3*b*, and 3*c*, the system may also include a sound transducer or speaker 110 disposed on the motion platform 104 beneath the level of the occupant positioned therein on the top surface of the mattress 108. The sound transducer 110 may include one or more signal sources connected thereto such as a phonograph, tape player, electronic signal generator, or similar controllable sound generator for generating a variety of different simulated sounds or actual recordings of the noises present in the near-term pregnant uterus. It may also comprise other sounds such as music or house sounds which may be generated electronically, recorded on tape, or played from a remote transmitter (not shown) and reproduced via a receiver (not shown) as a signal source in the mattress 102. The sounds are reproduced from the sound transducer 110, which is suitably mounted below the mattress 108. Sounds thus directed to the infant, like other environmental factors, may be gradually changed over a period of a few months from intrauterine sounds to sounds typical of the outside world.

The motion platform 104 is supported by the suspension system which includes two thin flexures 106 at opposite ends that are formed of plastic, or the like, and that have their pivots in the center portion of the flexure 106 affixed to the base plate 112 via lower mounting brackets 114, which are flexure supports, and that have their outer ends affixed to the motion platform 104 via upper mounting brackets 116.

The flexures 106 preferably include compliant sections 111 that flex so that the flexure 106 hinges to accommodate linear motion of the motion platform 104. The flexures 106 are substantially symmetrical about a longitudinal central axis 123 and are flexible at the compliant sections 111 along the longitudinal direction between the longitudinal central axis 123 and opposite ends of the flexures 106 and are rigid along a vertical axis between the longitudinal central axis 123 and the opposite ends of the flexures 106. This specific design enables the motion platform 104 to undergo essentially linear motion along the longitudinal central axis 123 and rotational motion along an axis substantially aligned with the longitudinal central axis of the mattress 102 while keeping the motion platform 104 constrained against lateral movement. As the motion platform 104 moves relative to the base plate 112, the flexures 106 hinge at the compliant sections 111 in a direction along the longitudinal central axis 123 of the mattress 102.

The motion platform 104 supports and carries the mattress 108 via the flexures 106 and associated parts as described below. The upper mounting brackets 116 on a bottom surface of the motion platform 104 each have a claw-like structure to grasp a flexure end 184 of one of the flexures 106. Additionally, the upper mounting bracket 116 may include "snap" latches that allow the end 184 of the flexure 106 to be quickly inserted in the upper mounting bracket 116 and retain the end of the flexure 106 after such insertion. The end 184 of the flexures 106 are flexures that are approximately perpendicular to the body of the flexure 106. The ends 184 have compliant sections 185 that flex so that the ends 184 hinge to accommodate the flexing of the body of the flexure 106 during the linear movement of the motion platform 103. As the motion platform 103 moves, the body of the flexure 106 hinges at the compliant sections 111 and pulls on one end 184 to thereby bend the end 184 at the compliant sections 185 to pull the end 184 toward the longitudinal axis 123 and in the direction of the linear movement. The other end 184 is pushed to thereby bend that end 184 at the compliant sections 185 thereof and to push the end away from the longitudinal axis 123 and in the direction of the linear movement. The flexure 106 includes compliant sections 186 arranged approximately perpendicular in the center of the body of the flexure 106 to allow the center of the flexure 106 to bend during the linear and rocking movements.

The motion mechanism 103 includes a suspension system, which is anchored to the base plate 112, drives the motion platform 104, and also includes an actuator 128 for generating linear motion along a longitudinal axis of the mattress 102 and for generating rotational rocking motion about the longitudinal axis. The actuator 128 may be, for example, a hydraulic piston-cylinder machine including a Belofram (TM) hydraulic diaphragm.

Figure 5:
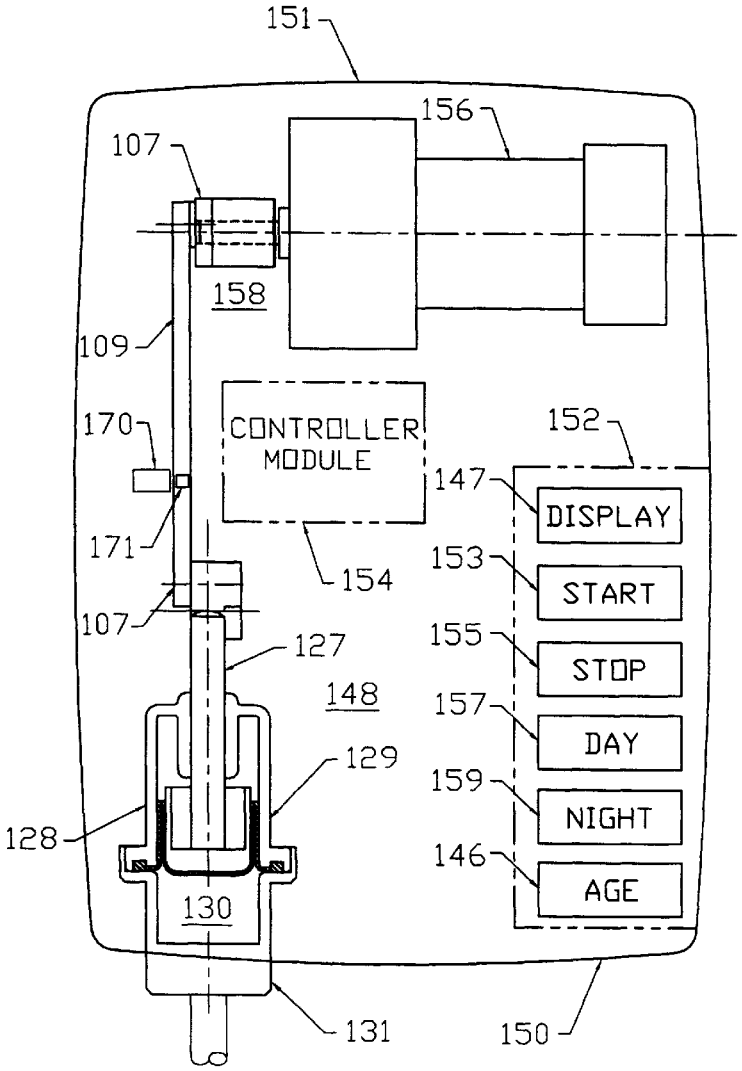
FIG. 5 is top view of a controller unit.
Figure 6:
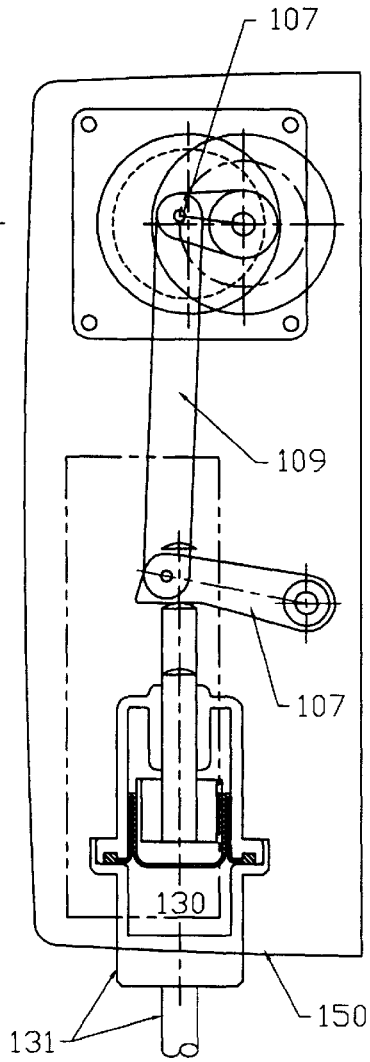
FIG. 6 is a side view of the controller unit.

Referring specifically to FIGS. 5 and 6, there are shown top and side view diagrams, respectively, illustrating a controller unit 148, which includes an actuator 128, a housing 150, a controller drive mechanism 151, a control panel 152, a controller module 154, and a motor 156. The controller unit 148 is preferably outside and near the mattress 102. The controller drive mechanism 151 transduces an electrical input to the controller unit 148 into mechanical work within the motion mechanism 103 to thereby impart linear and rocking motion to the mattress 108. The electrical energy into the control module preferably is transferred into mechanical energy by first transducing the electrical energy to hydraulic energy within the controller unit 148, and then transferring the hydraulic energy to the motion mechanism 103 of the mattress 102.

The control panel 152 may be, for example, a plastic membrane disposed over push button selectors. The control panel 152 includes a start button 153 and a stop button 155 to enable and disable, respectively, the controller module 154, and includes a day selector 157 to select day motion settings, a night selector 159 to select night motion settings, an age selector 146 to select where in a time-varying motion program the infant of certain age properly fits, and a display 147 to display the age. The controller module 154 controls the operation of the mattress 102, in a manner similar to that described in U.S. Pat. No. 5,037,375.

Responsive to control signals from the controller module 154, the motor 156 drives the controller drive mechanism 151 to cyclically move a piston in the actuator 128. The motor 156 may be, for example, a low-voltage DC motor that receives low-voltage power from an external power source (not shown). The motor 156 is preferably geared down internally to deliver torque most efficiently to drive the controller drive mechanism at about fifteen cycles per minute in a day mode and at about ten cycles per minute in a night mode. The sound transducer 110 may provide intrauterine sounds continuously when the mattress 102 is operational. The linear and rotational movements of the mattress 102 may be produced as described below in a random intermittent manner.

The controller drive mechanism 151 interconnects the motor 156 to the actuator 128, to provide linear motion from rotary motion. More specifically, one end of a crank 107 is attached to a motor shaft 158, so that the crank 107 turns as would the hand of a clock as the motor 156 rotates. A first end of a link 109 pin-joins to the other end of the crank 107. A second end of the 109 pin-joins to one end of a link 117. The other end of the link 117 pins to a base of the housing 150. The lengths of the crank 107, the link 109, and the link 117 are selected so that constant rotary motion of the crank 107 produces reciprocal rotary motion of the link 117. At a point along the link 117, a drive rod 127 of the actuator 128 may either bear against the link 117 or pin-slot-join to the link 117. In a symmetric configuration, the linear translation of the drive rod 127 is approximately twice the length of the crank 107 and the reciprocal motion of the drive rod is harmonic.

Alternatively, the controller drive mechanism 151 may be a cam-follower (not shown). A piston extension or drive rod slides upon or follows the perimeter of a cam which turns with the motor shaft 158. For symmetric simple harmonic motion, the cam is circular and turns about an offset center.

Alternatively, the controller drive mechanism 151 may be a slider-crank (not shown). A crank is attached at one end to the motor shaft 158 as described for FIGS. 5 and 6. A second lever is pin-joined at one end to the other end of the crank and is pin-joined to the actuator 128 at its other end. In a symmetric configuration, the linear translation of the drive rod 127 is approximately twice the crank length and the reciprocal motion of the drive rod 127 is harmonic.

Figure 7:
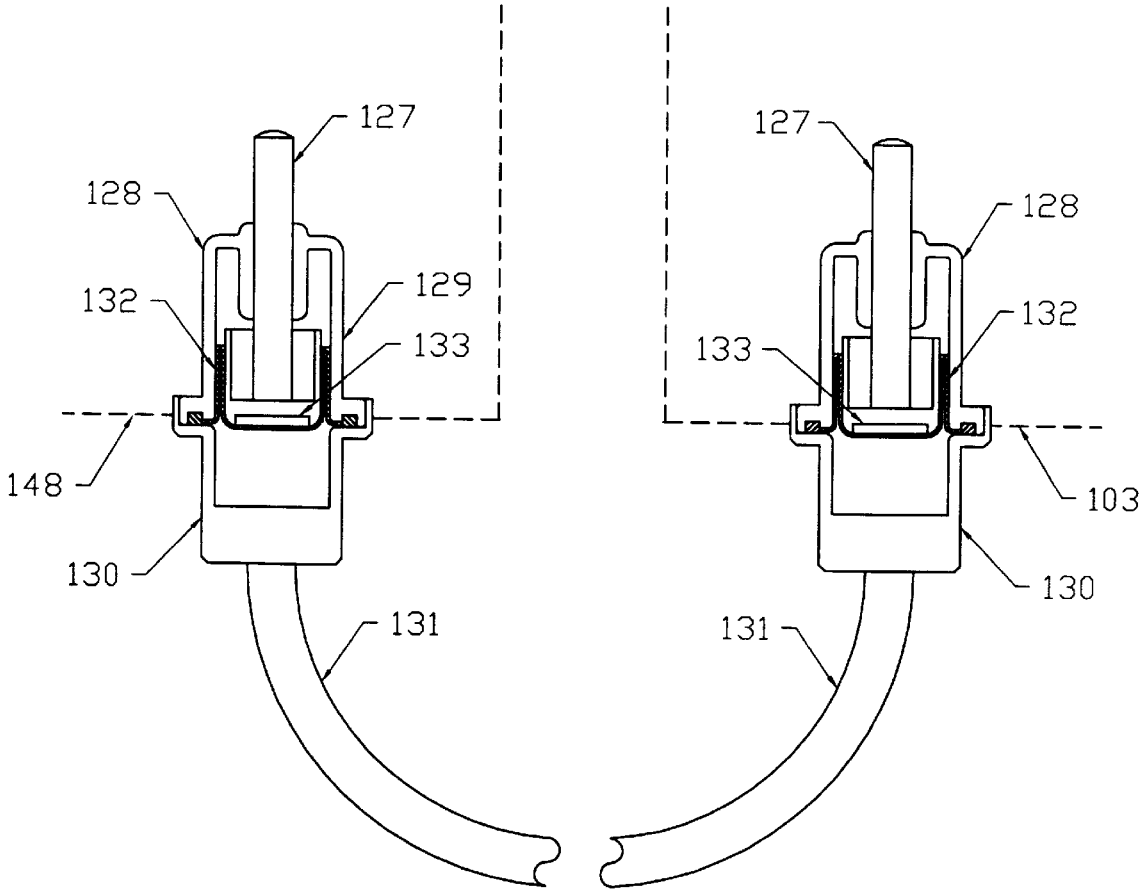
FIG. 7 is a cross-sectional view of the hydraulic system.

Referring to FIG. 7, there is shown a cross-sectional view of a hydraulic system, which includes two actuators 128, interconnected by a flexible thick-wall connecting tube 131. The actuators 128 in the controller 148 and in the motion mechanism 103 of the mattress 102 operate as a master and a slave, respectively. The actuator 128 includes a mechanical portion 129 and a hydraulic portion 130, which are separately housed.

The hydraulic portion 130 of the actuator 128 includes a rolling diaphragm 132. The rolling diaphragm 132 substantially lacks friction, which results in lower displacement forces than that of conventional piston-cylinder machines. The actuator 128 may include a connector that provides quick fastening and quick releasing to allow the hydraulic portion 130 to be separated from and reconnected to the mechanical portion 129 without compromising hydraulic integrity. Preferably the actuator mounted within the motion mechanism 103 has such a connector. Such connectors allow the hydraulic system to be removed easily from the mattress 102 to facilitate moving and storage of the mattress 102.

The hydraulic portion 130 of each actuator 128 is attached and sealed to an end of the connecting tube 131. The rolling diaphragm 132 of each actuator 128 is also attached and sealed to the housing of the hydraulic portion 130. The outer periphery of the rolling diaphragm 132 preferably has a shape of an O-ring to function as an O-ring and provide mechanical sealing when the hydraulic portion 130 is fastened to the mechanical portion 129. The hydraulic portions 130 of both actuators 128 and the connecting tube 131 form a detachable subassembly that is a hydraulic transduction link between the controller unit 148 and the mattress 102 and is an integral flexible pressure vessel. The connecting tube 131 is preferably filled with an incompressible fluid, which is preferably non toxic to humans, such as vegetable oil. For an incompressible hydraulic fluid, (the volume of the hydraulic fluid remains constant), a deflection of either rolling diaphragm 132 results in an opposite predeterminable deflection of the other, i.e., if the diaphragm 132 of one actuator 128 is deflected toward the connecting tube 131, the diaphragm 132 of the other actuator 128 is similarly deflected away from the connecting tube 131. The hydraulic fluid is preferably at a low positive pressure relative to the surrounding air to provide a greater seal by the rolling diaphragm 132. A rigid metal disk 133 is mounted to the center portion of the surface of the rolling diaphragm opposite the fluid. The hydraulic portion 130 and the connecting tube 131 preferably cannot be disassembled easily by the user.

The mechanical portion 129 of each actuator 128 includes the drive rod 127 and a bearing. One end of the drive rod 127 extends from the actuator 128 drives or follows the mechanical linkage of the controller drive mechanism 151 or of the motion mechanism 103. The other end of the drive rod 127 is internal to the actuator 128 and engages or is fastened to the disk 133 on the rolling diaphragm 132.

Referring specifically to FIGS. 3*a*, 3*b* and 3*c*, there are shown top, side, and end views of the motion mechanism 103. A link 120 has a first end anchored at a pin-joint 119 to the base plate 112 on the longitudinal axis 123. The other end of the link 120 and one end of a link 122 are pin-joined at a joint 126. The other end of the link 122 is pin-joined to a joint 124, which is attached to the motion platform 104. The joint 124 moves longitudinally to thereby impart the reciprocal linear motion to the motion platform 104. To allow for the rocking of the motion mechanism 103, the links 120 and 122 preferably provide sufficient torsional compliance and compressive stiffness so that the link 122 may be pin-joined at the joint 124 without buckling the links 120 and 122 when they are longitudinally aligned. The drive rod 127 of the slave actuator 128 contacts the link 120 at a bearing point 140 to urge the link 120 to pivot about the pin joint 119 and to urge the link 122 to pivot about the joint 124. As the link 122 pivots, the joint 124 moves longitudinally to linearly move the motion platform 104.

A return spring 121 attached to the base plate 112 and to the link 120 provides holonomic contact between the drive rod 127 of the slave actuator 128 and the link 120 throughout the motion cycle. The spring 121 also provides positive differential pressure within the hydraulic system. As the drive rod 127 of the slave actuator 128 moves into the actuator 128, the spring 121 compresses and thereby pulls the link 120 towards the actuator 128. This pulling causes the motion platform 104 to move linearly in the opposite direction.

In the particular implementation shown in FIG. 3, the bearing point 140 is located less than a quarter of the length of the link 120 from the pin-joint 119 to provide a longitudinal stroke at the pin-joint 124 and that of the motion platform 104 is approximately ¾ inch along the longitudinal axis. The resulting angular motion of the link 120 is ±27°. High lateral stiffness of flexures 106 relative to their compliance in the direction of the longitudinal axis 123 so that the motion platform moves linearly only along the longitudinal axis 123. The rocking motion of the motion platform 104 about the longitudinal axis 123 preferably is less than ±5°.

It is desired to make the thickness of the mattress 102 as close to standard as possible. To reduce the thickness of the mattress, a pulley system preferably provides the rocking motion.

Referring again to FIG. 5, a position encoder 170 detects and counts the motion cycles of the link 109. The controller module 154 may indicate the need of service or parts change or automatically shut down the system to prevent a less desirable wear or fatigue failure mode, if the accumulated number of cycles exceeds a predetermined threshold. The position encoder may include a Hall effect sensor in the reluctance loop of a permanent magnet circuit. A magnet 171 may be affixed to the link 109. A cycle is counted each time the motion of the link 109 moves the magnet in close proximity to the Hall effect sensor. Alternatively, the position encoder 170 may be an optical encoder, variable capacitance encoder, or a Faraday effect velocity encoder which also may use the Hall effect sensor. A bar pattern applied to a motion link in the system may act as the scale relative to a reticle, a light source and a light detector within an optical encoder to provide digital encoding.

Alternatively, the position encoder 170 may provide position and velocity indications to the controller module 154 as feedback signals. Responsive to such feedback, the controller module 154 varies the rotational speed of the motor 156.

Figure 4A:
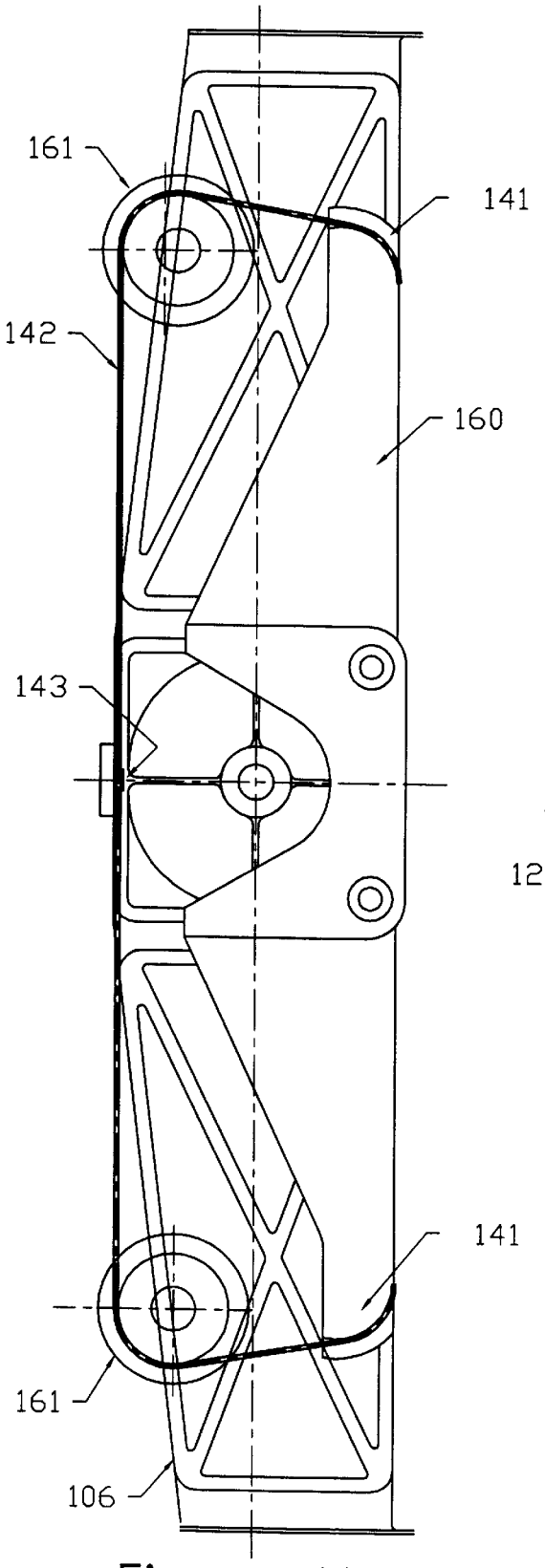
FIGS. 4*a* and 4*b* are side and top views, respectively, of a rocker assembly fastened to a flexure of the motion mechanism.
Figure 4B:
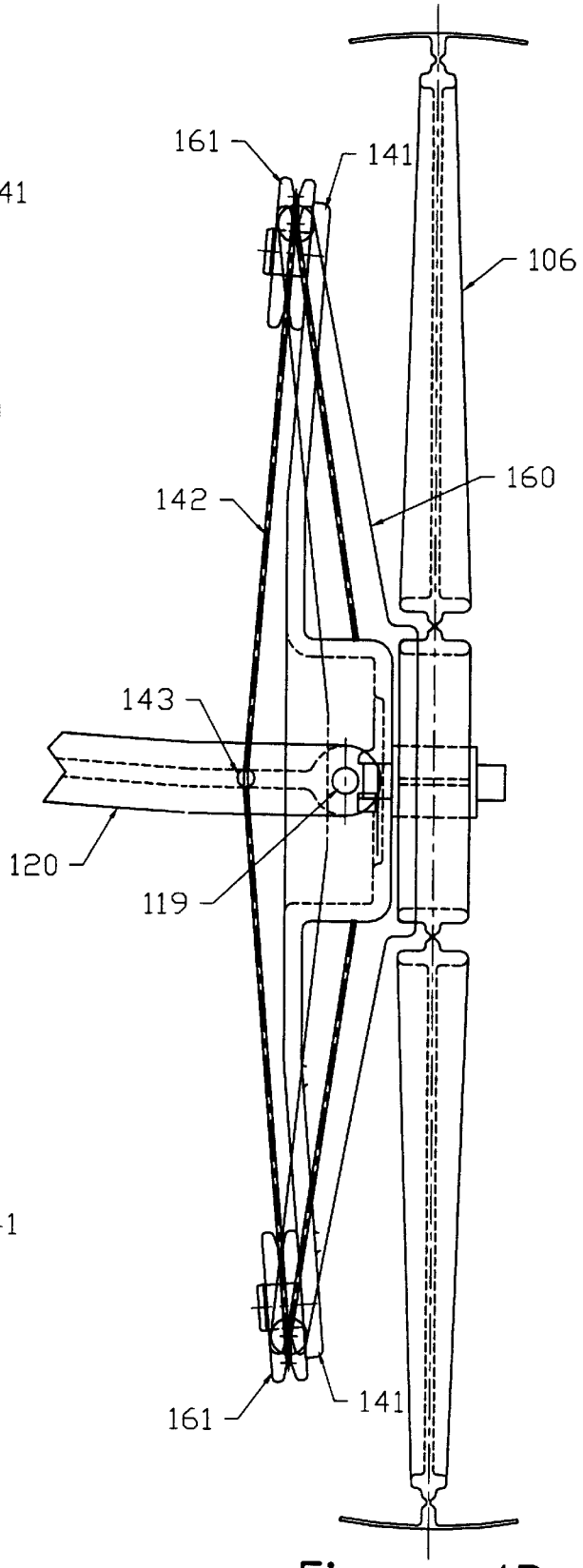

Referring to FIGS. 4*a* and 4*b*, there are shown respective side and top views of a rocker assembly. A rocker arm 160 is affixed to and extends outward from the flexure 106 that is closest to the pin-joint 119. The rocker arm 160 preferably is C-shaped in the top view. A flexible cable 142 is affixed to the rocker arm 160 at ends 141 and to the link 120 at pulley 143. The distance between the end 141 on the link 120 and the pin-joint 119 is selected in order to produce a nominal angle of rocking for the motion platform 104 relative to the longitudinal axis 123 of ±4.75°. The actuator 128 drives the link 120 to thereby drive the cable 142. The pulley 143 has a circumferential helical slot that engages the cable 142 so that the cable 142 is wrapped around the pulley 143 for at least one wrapping. The pulley 143 reciprocates in a plane parallel to that of the base plate 112. The centers of pulleys 161 are anchored to the base plate 112 (anchor not shown). The cable 142 rides on the pulleys 161 which converts the reciprocal motion of the cable 142 parallel to the base plate 112 at pulley 143 on the link 120 to reciprocal motion of the cable 142 perpendicular to the base plate 112 at ends 141 on the rocker arm 160. The reciprocal motion at each of the two ends 141 on the rocker arm 160 is substantially 180° out of phase with the other. The flexure 106, to which the rocker arm 160 is affixed, is constrained to rotate about the longitudinal axis 123. Thus, the phased motion imparted to the rocker arm 160 perpendicular to the base plate 112 causes the rocker assembly to reciprocally rotate or rock about the longitudinal axis 123 and causes the motion platform 104 to which the rocker assembly is firmly attached via the flexure mounting brackets 116 (FIG. 3) also to rock about the longitudinal axis. As is experienced by a fetus within a uterus, the rocker assembly creates two reciprocating longitudinal cycles per rocking cycle.

Figure 8A:
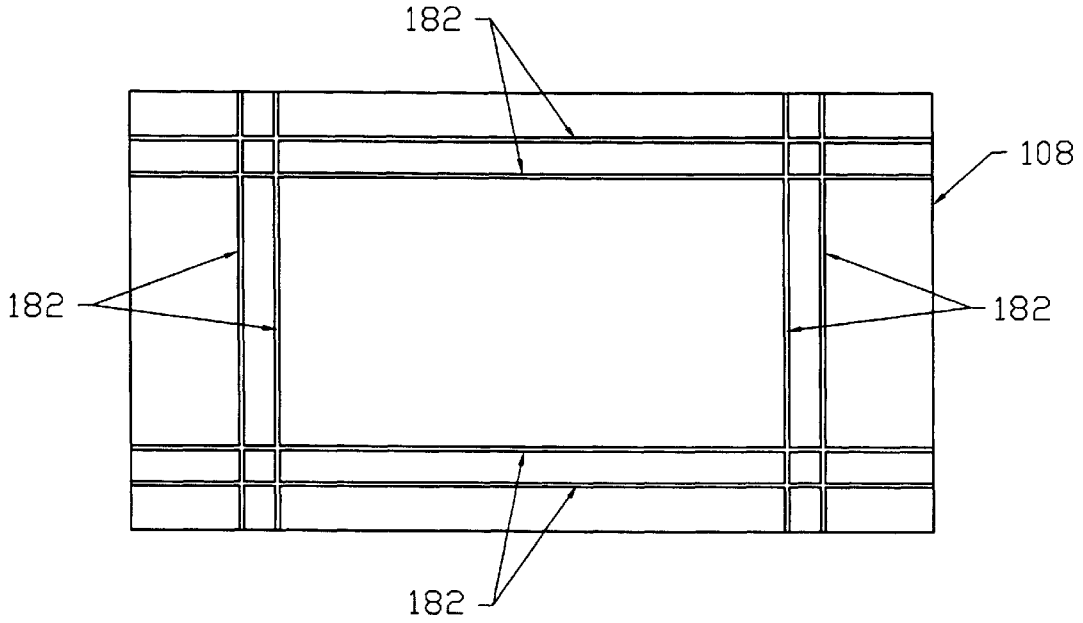
FIG. 8*a* and 8*b* are top and bottom views, respectively, of the mattress.
Figure 8B:
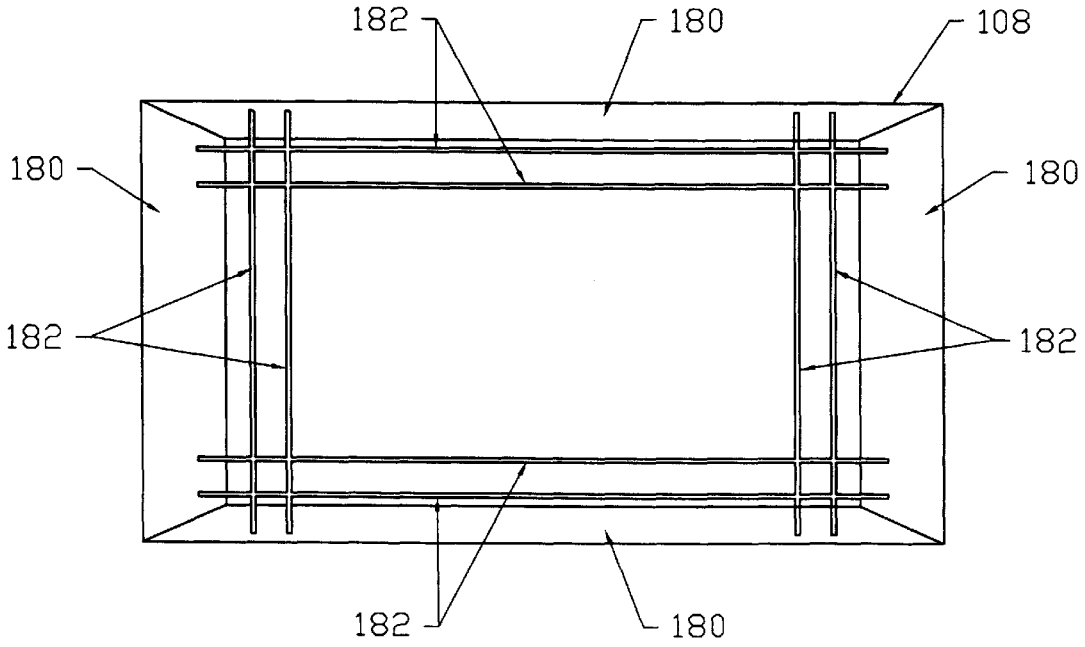

Referring specifically to FIGS. 8*a* and 8*b*, the mattress 108 slides on the mattress 102 to accommodate the linear motion of the motion mechanism 103. The mattress 108 has chamfered edges 180 along a bottom surface. The mattress 102 has chamfered edges 181 (FIGS. 2*a* and 2*b*) that engage the chamfered edges 180 of the mattress 102. The chamfered edges 180 and 181 preferably are covered by a film or coating with a low coefficient of friction to reduce the force required to move the mattress 108 relative to the mattress 102. The motion mechanism 103 preferably bears the weight of the occupant and of the portion of the mattress 108 engaging the motion mechanism 103. The edges 181 preferably bears the weight of the portion of the mattress 108 engaging the edges 181. The mattress 108 preferably is formed of a medium density foam.

The mattress 108 has a plurality of grooves 182 in the top and bottom surfaces of the mattress that hinge to accommodate the rocking motion by facilitating the deformation and bending of the mattress 108. The mattress 102 has clearance between the mattress 102 and the mattress 108 to allow the bending of the mattress 108 at the grooves. The mattress 102 and the motion mechanism 103 also support the deformation of the mattress 108 caused by the weight of the infant which of course typically varies with the age of the infant. The mattress 102, the mattress 108, and the motion mechanism 103 preferably are enclosed in a mattress cover (not shown) having elastic regions to stretch during the linear and rocking motions.

Figure 9:
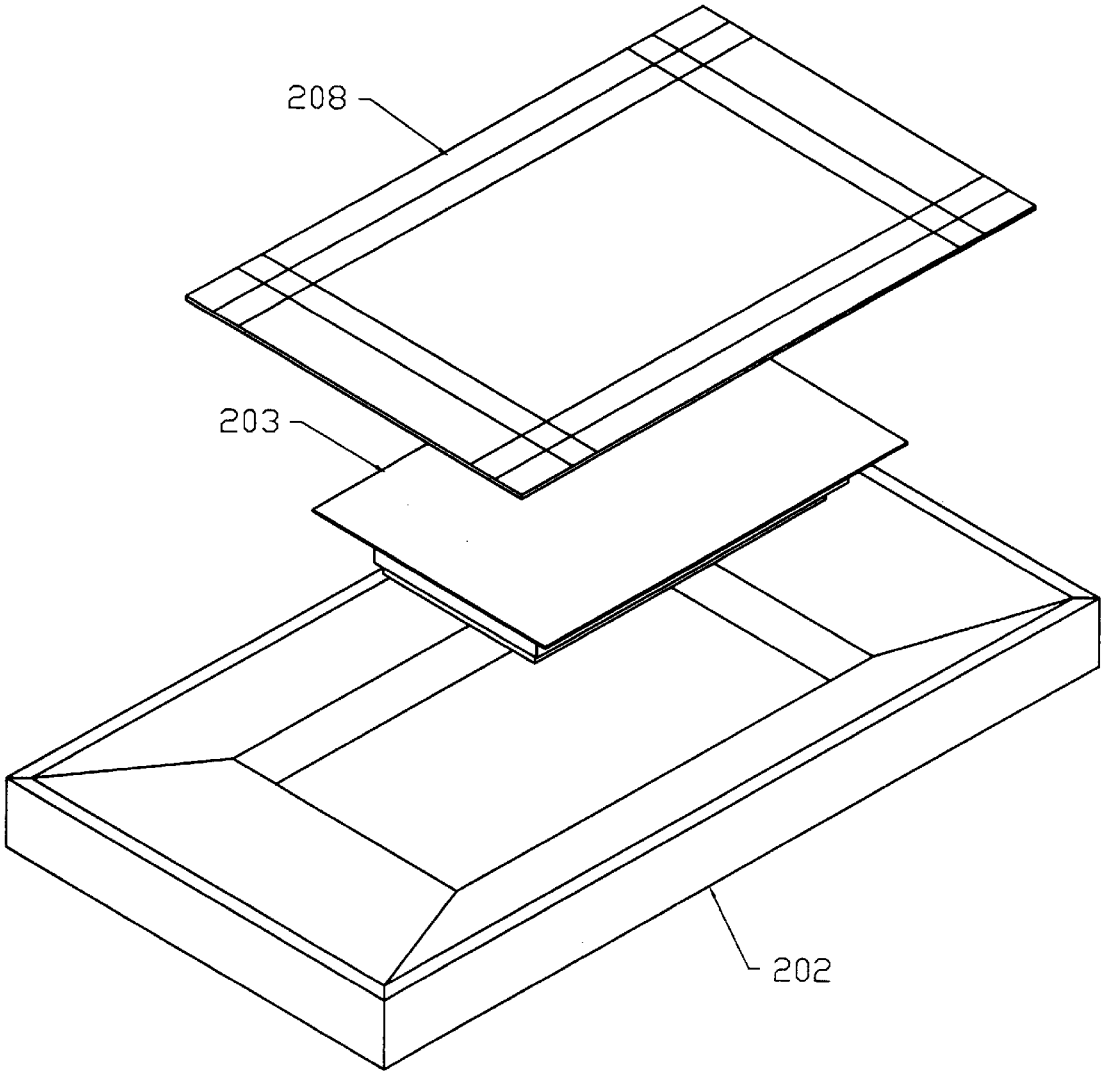
FIG. 9 is a perspective view of a mattress and of the subsystems housed within the mattress or a second embodiment.

Referring specifically to FIG. 9, the system includes a mattress 202 having a box-like shape and having thick sidewalls and bottom surface that are stationary and firm. The sidewalls house, support, and constrain a motion mechanism 203. The motion platform 204 is mounted to the top surface of the mattress 202 and is supported for motion along several axes by a suspension system including flexures 206 and 207. The mattress 202 includes a soft, form fitting mattress 208 on a top surface of the motion platform 204 on which the infant rests.

Figure 10:
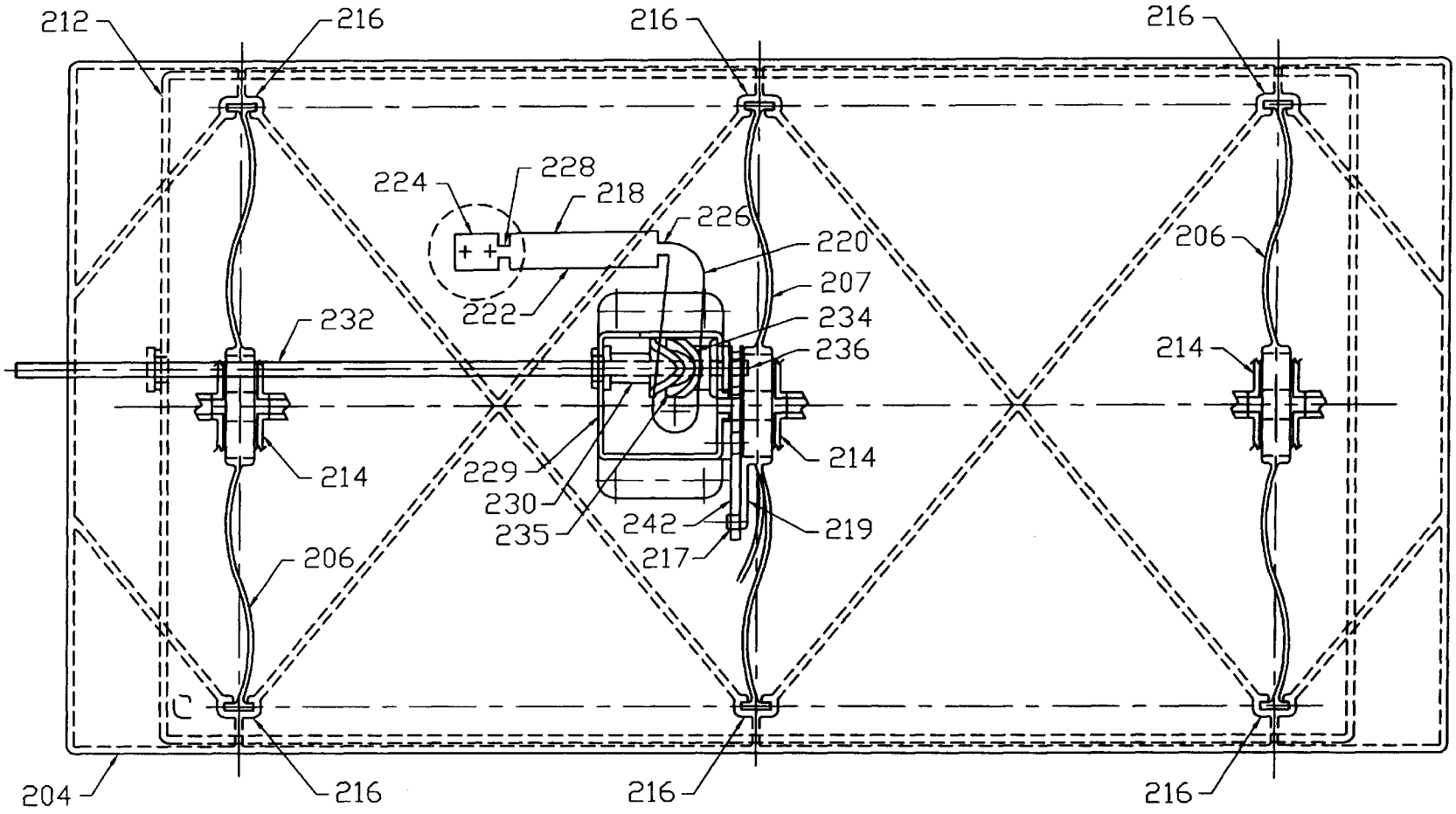
FIG. 10 is a top cross-sectional view of the mattress of the environmental transition system of FIG. 8.
Figure 11:
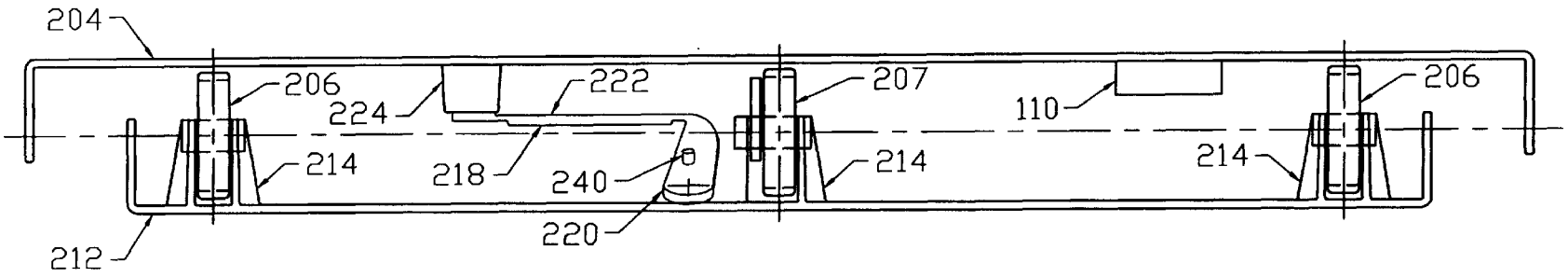
FIG. 11 is a side cross-sectional view of the mattress with an actuator housing and cam shaft assembly removed.

Referring specifically to FIGS. 10–11, the system may also include a sound transducer or speaker 110 disposed on the motion platform 204 beneath the level of the infant positioned therein on the mattress 208. The motion platform 204 is supported by a suspension system which includes two thin flexures 206 at opposite ends and one thin central flexure 207 that are formed of plastic, or the like, and that have their pivot in the center portion of the flexure affixed to a base plate 212 via lower mounting brackets 214, and that have their outer ends affixed to the motion platform 204 via upper mounting brackets 216. The flexures 206 and 207 preferably have an S-shaped transverse cross section. The flexures 206 and 207 are substantially symmetrical about the longitudinal central axis and are flexible along the longitudinal direction between the longitudinal central axis and opposite ends of the flexures 206 and 207 and are rigid along a vertical axis between the longitudinal central axis and the opposite ends of the flexures 206 and 207. This specific design enables the motion platform 204 to undergo essentially linear motion along the longitudinal central axis and rotational motion along an axis substantially aligned with the longitudinal central axis of the mattress 202 while keeping the motion platform 204 constrained against lateral movement. As the motion platform 204 moves relative to the base plate 212, the flexures 206 and 207 bend in a direction along the longitudinal central axis of the mattress 202 that is aligned with a cam shaft 232, described below.

The motion platform 204 supports and carries the mattress 208 via the flexures 206 and 207 and associated parts as described below. The upper mounting brackets 216 on a bottom surface of the motion platform 204 each have a claw-like structure to grasp an end of one of the flexures 206 and 207. Alternatively, the upper mounting bracket 216 may include "snap" latches that allow the end of the flexure 206 and 207 to be quickly inserted in the upper mounting bracket 216 and retain the end of the flexure 206 and 207 after such insertion. The flexure 207 includes an actuation stud 217 integral with an extension arm 219. The actuation stud 217 preferably has a rectangular cross-section.

A linear follower 218 is formed of plastic, or the like, and has a pivoting portion 220 affixed to the base plate 212 via a screw, has a linear portion 222 and has a terminal portion 224 affixed to the motion platform 204 via screws or "snap" latches. A first flexure 226 couples the pivoting portion 220 to a first end of the linear portion 222. A second flexure 228 couples the terminal portion 224 to a second end of the linear portion 222 opposite said first end of the linear portion 222. The linear follower 218 operates as a lever for linearly moving the motion platform 204 as described below. The first and second flexures 226 and 228 allow the linear follower 218 to bend during rotational movement.

An actuator housing 229 that is mounted to the base plate 212 includes a cam shaft assembly 230 that is an actuator that couples to the flexure 207 and the linear follower 218 to impart linear and rotational motion to the motion platform 204. The cam shaft assembly 230 includes a cam shaft 232 that is formed of steel, and includes a barrel cam 234, and a eccentric cam 236. The eccentric cam 236 is on an end of the cam shaft assembly 230 opposite the cam shaft 232. The barrel cam 234 has a groove or slot 235 in the outer circumferential surface that engages a linear follower stud 240, integrally molded on the pivoting portion 220 of the linear follower 218, to impart to the linear follower 218 linear motion that is aligned with the cam shaft 232. The groove 235 has a longitudinal displacement in the circumferential surface so that, as the linear follower stud 240 moves within the groove 235, the linear follower 218 linearly moves back and forth along the longitudinal axis of the mattress 202 over a distance that simulates the movement of a fetus in an intrauterine environment. Such movement is described in U.S. Pat. No. 5,037,375, the subject matter of which is incorporated herein by reference.

Figure 12:
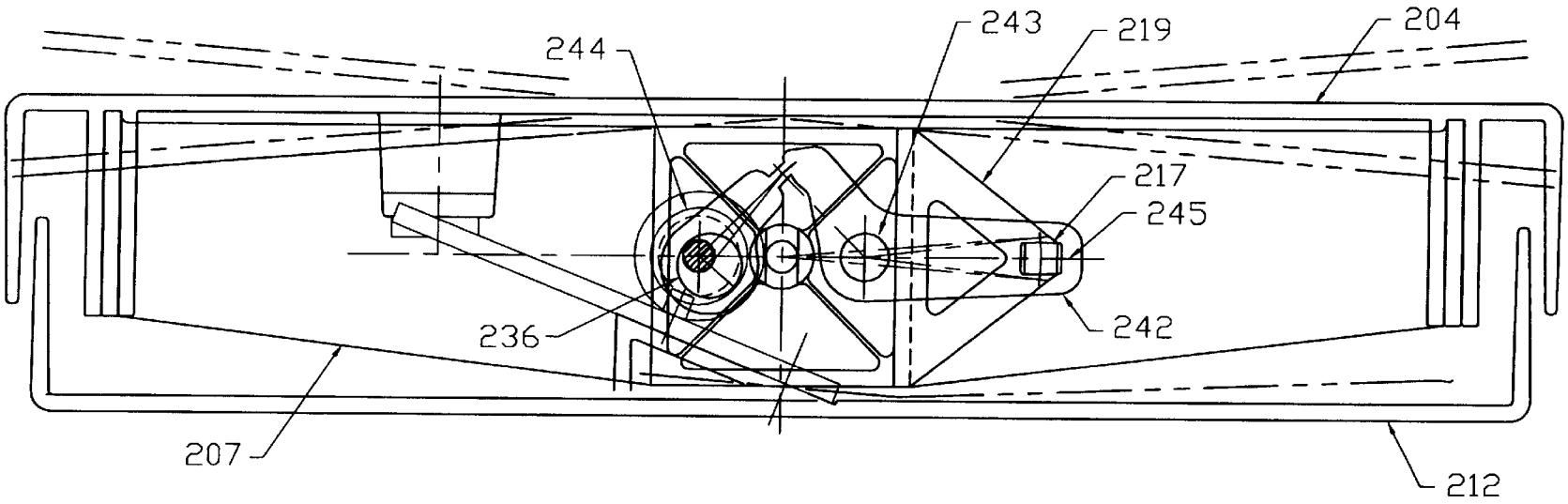
FIG. 12 is an end cross-sectional view of the mattress showing the coupling of a rocker to the cam shaft assembly and to a center flexure.

Referring specifically to FIG. 12, a rocker 242 has a center hole 243 that pivots on a post provided on a side wall of the actuator housing 229. A cam following hole 244 of the rocker 242 engages the eccentric cam 236 on the end of the cam shaft assembly 230. A rectangular hole 245 in the rocker 242 engages the actuator stud 217 on the center flexure 207. As the cam shaft assembly 230 rotates, the eccentric cam 236 engages a portion of the cam following hole 244 and rotates within the hole 244 to thereby cause the rocker 242 to pivot and thereby impart a rotational rocking motion to the motion platform 204 to simulate the movement of a fetus in an intrauterine environment. The cradle rocks as shown by the broken lines in FIG. 12.

Thus, the cam shaft assembly 230 rotates to cause the barrel cam 234 to drive the linear follower 218, thereby imparting linear motion to the motion platform 204, and to cause the eccentric cam 236 to impart an angular displacement to the rocker 242 that imparts a rotational motion to the center flexure 207 via the actuation stud 217 to thereby 'rock' the motion platform 204. In the preferred embodiment, each revolution of the cam shaft assembly 230 imparts two cycles of linear motions and one cycle of rotational motion. The phasing of the linear motion and rotational motions are selected to simulate the movement of a fetus in an intrauterine environment as described in U.S. Pat. No. 5,037,375, and may be altered by relatively rotating the fixation of the eccentric cam 236 and the barrel cam 234 on the shaft 230.

Figure 13:
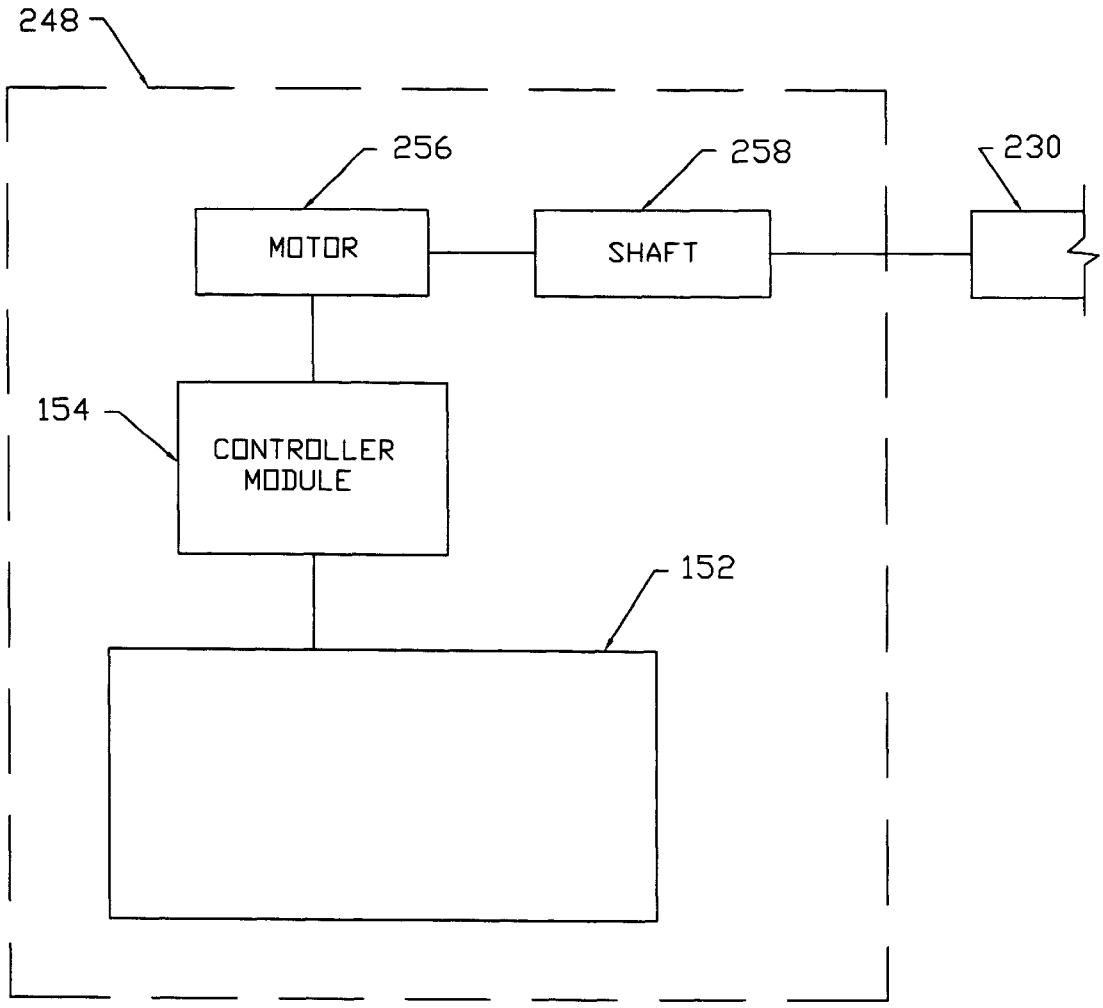
FIG. 13 is a block diagram of the controller unit for the mattress.

Referring specifically to FIG. 13, a controller unit 248 includes a housing 250, a control panel 152, a controller module 254, a motor 256, and a shaft 258. The controller module 254 controls the operation of the mattress 202, in a manner similar to that described in U.S. Pat. No. 5,037,375. The motor 256 may be, for example, a low-voltage DC motor that receives low-voltage power from an external power source (not shown). The shaft 258 preferably is flexible and is coupled to the cam shaft assembly 230 so that both rotational and linear motion of the shaft 258 is transferred to the cam shaft assembly 230. Responsive to control signals from the controller module 254, the motor 256 drives the cam shaft assembly 230 via the flexible shaft 258.

The motor 256 preferably drives the cam shaft assembly 230 at about fifteen cycles per minute in a day mode and at about ten cycles per minute in a night mode. The sound transducer 110 may provide intrauterine sounds continuously when the mattress is operational. The linear and rotational movements of the mattress may be produced as previously described in a random intermittent manner.

The movement mechanism comprising the flexures 206 and 207, the linear follower 218, the actuator housing 229, and the cam shaft assembly 230 is fully contained within the mattress 202. The mattress 202 includes a perimeter wall 270 extending upwardly along the periphery of the motion platform 204. The mattress 208 is on the top surface of the motion platform 204 and within the perimeter wall 270. The perimeter wall 270 preferably is approximately four inches high and formed of a medium density foam. The mattress 208 is preferably the mattress 108 described above. The mattress 208 is covered with a fabric or plastic cover. The mattress 202 also may support a bolster about an infant to simulate the confining intrauterine tactile environment, as described in U.S. Pat. No. 5,037,375.

Figure 14:
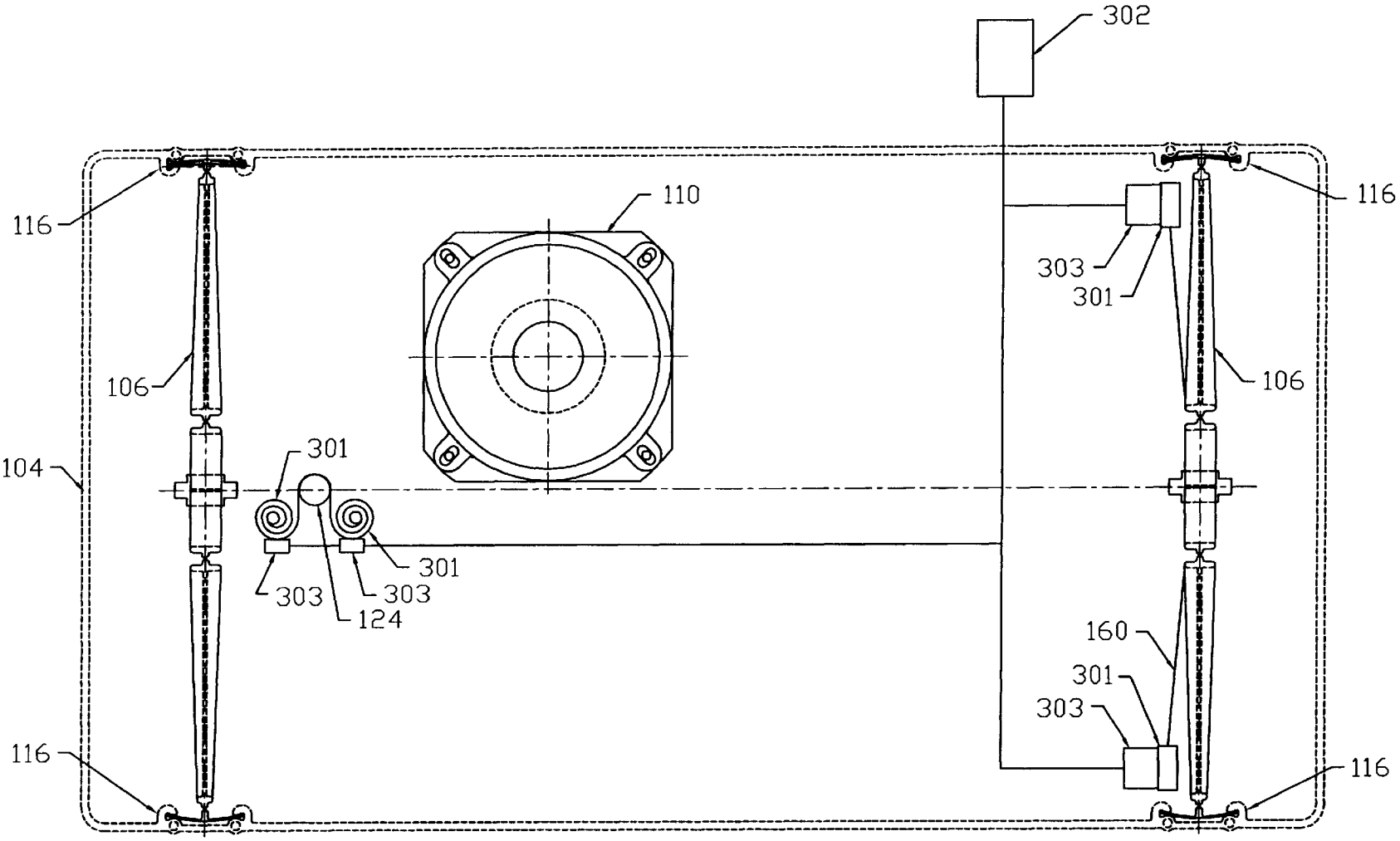
FIG. 14 is a top view of a mattress using thermal actuators.

Referring to FIG. 14, there is illustrated another embodiment of the environmental transition system that includes a movement mechanism that is thermally actuated. Such a system includes a base plate 112, a motion platform 104, and flexures 106 as described above. Such systems do not include a motor. Instead, thermal actuators 301 are coupled to the flexures 106 and to the motion platform 104. A controller unit 302 applies electrical power to heating elements 303 adjacent the thermal actuators 301, which respond to the heat to expand and contract, and thereby impart the linear and rotational motions to the motion platform 104. A heat-sinking compound or element (not shown) may be coupled to the thermal actuators 301 and the heating elements 303 to improve the cooling and contracting of the thermal actuators 301 for controlled responses in varying environmental conditions. Such a system operates quietly in the absence of a motor and conventional actuators. The thermo-mechanical system changes the position of the motion platform 104 by causing either a change of temperature within or a temperature gradient within one or more thermal actuators 301.

The thermal actuators 301 preferably are formed of a bi-metal material as a strip wound into a watch-spring configuration so that heating the actuators 301 winds the spring tighter. One of the thermal actuators 301 are affixed to the base plate 112 and to an end of the rocker arm 160. Rocking may be produced by alternatively heating the two thermal actuators 301. Similarly, two such elements may be strung from opposite ends of the base plate to the joint 124 on the motion platform 104. Reciprocating displacement may be produced by alternately heating the two elements. Alternatively, the bi-metals utilized can be electrically conductive. In this case, the controller 302 applies a current to the actuator 301 to heat the actuator.

The thermal actuators 301 may be a cold worked machine element of shape-memory alloy that remembers its unworked shape when the element is heated to its critical temperature. As temperature exceeds the critical temperature, the force to return the element to its unworked shape increases. Titanium-nickel (TiNi) alloys exhibit super-elasticity as well as shape-memory. Thus the change in shape from unworked state to cold worked state can be very large. Using shape-memory thermo-machine elements allow movements on the order of 1 inch for temperature changes on the order of 10° C.

Figure 15:
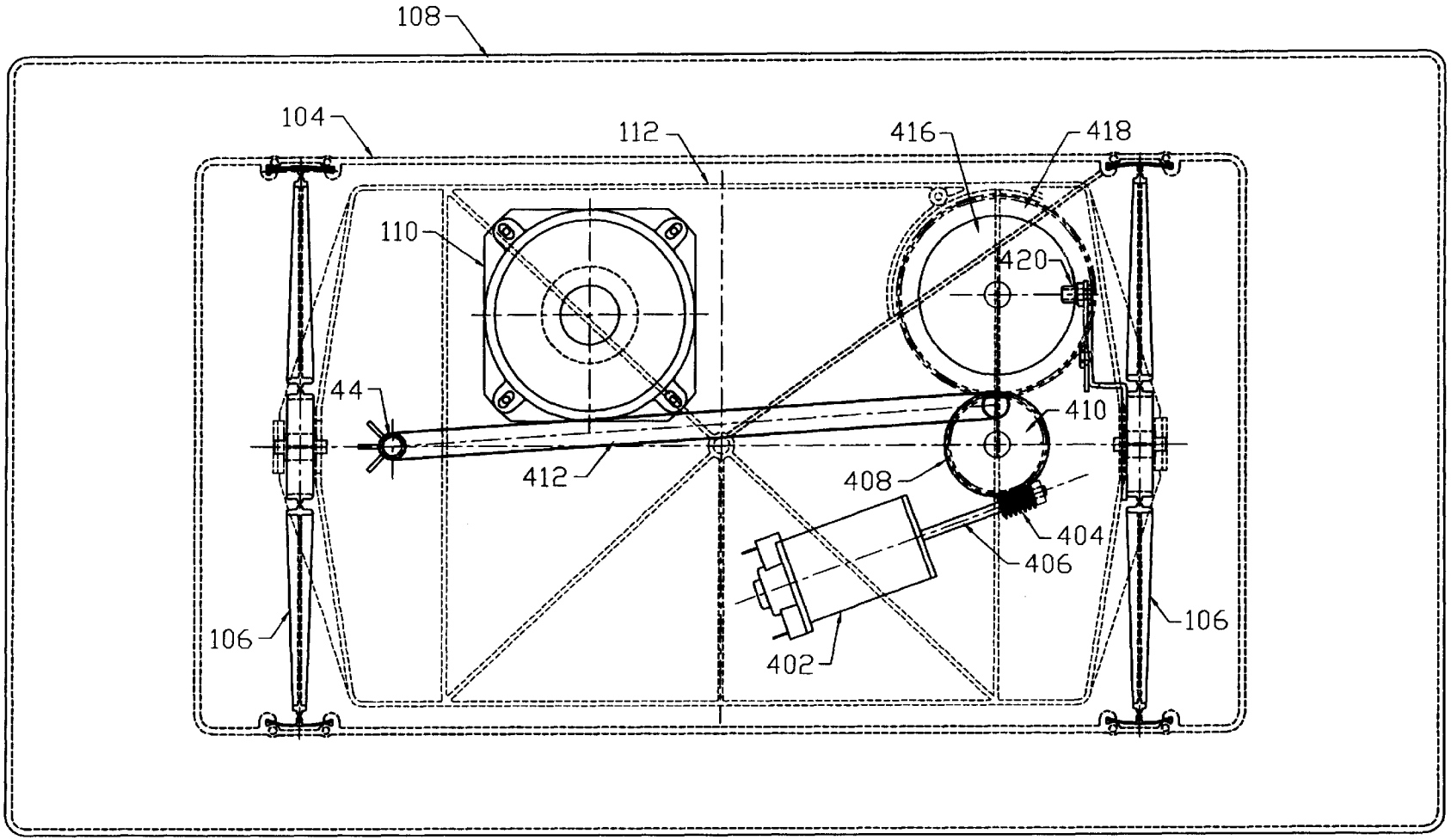
FIG. 15 is a top view of a mattress and of the subsystems housed within the mattress for a third embodiment.

Referring to FIG. 15, there is shown a top view of a mattress and of the subsystems housed within the mattress for a third embodiment. The mattress includes a pair of flexures 106 mounted to opposite ends of the base plate 112. A DC motor 402 receives DC power from an external power source (not shown), such as a conventional AC to DC transformer that is plugged into a wall power outlet. A worm gear 404 is mounted to a shaft 406 of the motor 402 for rotation about the rotational axis of the shaft 406. The worm gear 404 has a helical groove on the outer surface thereof that engages teeth of a worm wheel 410 attached to a spur gear 408 mounted to the base plate 112 for rotation about an axis of the worm wheel 410. The spur gear 408 of the worm wheel 410 preferably has 60 teeth. A linear drive link 412 has a first end pin jointed to the worm wheel 410 at a point offset from the center of the worm wheel 410. The linear drive link 412 has a second end ball jointed to a joint 414 on the motion platform 104. As the motor 402 rotates, the worm gear 404 rotates the worm wheel 410 to thereby drive by an eccentric motion the linear drive link 412 in a back and forth linear motion and likewise move the motion platform 104 and the mattress 108.

A barrel cam 416 has a spur gear 418 having teeth engaging both the spur gear 408 and a roller 420. The barrel cam 416 rotates about an axis in response to rotation of the worm wheel 410. The roller 420 pivots on a stud on a first end of a cam follower 422. A second end of the cam follower 422 is mounted to the center of one of the flexures 106. The relationship between the gearing of the spur gear 418 and the spur gear 408 provides a reduction in gearing and preferably is selected to provide an approximately 2:1 linear motion to rocking motion ratio. The spur gear 418 of the barrel cam 416 preferably has 120 teeth. As the roller 420 follows the barrel cam 416, the cam follower 422 about the axis 123, thereby rotating the flexure 106 and the motion platform 104.

The motor 402 is controlled by a controller unit (not shown) that includes a control panel 152 and a controller module that provides control signals to the motor similar to that of the controller module 154.

The environmental transition system therefore provides a smooth transition from the intrauterine environment to an extrauterine environment by providing stimulating motion and sound to an infant that can be programmed conveniently to vary selected parameters representative of the two environments over a programmed time period.

We claim:

1. An environmental transition system comprising:

a base plate having a plurality of flexure supports;

a platform spaced apart above the base plate, having a first surface facing the base plate, having a second surface opposite said first surface for supporting a mattress, and having a plurality of mounting brackets thereon;

a plurality of flexures for supporting the platform, each flexure being substantially symmetrical about a central axis, being mounted near the central axis to pivot about a corresponding one of the plurality of flexure, supports, and being flexible along a longitudinal direction between the central axis and opposite ends of the flexure and being rigid along a vertical axis between the central axis and said opposite ends that are attached to mounting brackets on said platform, the plurality of flexures supporting the platform; and an actuator disposed to flex the plurality of flexures between the opposite ends thereof in a direction to translate the platform along the central axis and to angularly displace the platform about the central axis.

2. The environmental transition system of claim 1 wherein the actuator comprises:

a linear follower having a first end coupled to the base plate, having a second end coupled to the platform, and having a stud thereon between said first and second ends; and a cam shaft assembly rotationally mounted to the base plate, having a circumferential surface, and having a slot in the circumferential surface engaging the stud of the linear follower, the slot having a longitudinal displacement in the circumferential surface that provides a corresponding longitudinal displacement of the stud of the linear follower during the rotational movement of the cam shaft assembly to linearly translate the platform in the direction along the central axis.

3. The environmental transition system of claim 2 wherein the cam shaft assembly has an eccentric cam thereon, the environmental transition system further comprising a rocker assembly coupling the eccentric cam and one of the plurality of flexures to translate the rotational movement of the cam shaft assembly to the flexure to thereby rotate the platform about the central axis.

4. The environmental transition system of claim 1 wherein the ratio of a cycle of translation of the platform and a cycle of angular displacement of the platform is 2:1.

5. The environmental transition system of claim 1 wherein the actuator comprises:

a first link having a first end coupled to the platform, and having a second end;

a second link having a first end coupled to the base plate, having a second end coupled to the second end of the first link, and having a bearing thereon between said first and second links for pivoting therebetween in response to urging near the bearing and providing a corresponding pivoting of the first link about the first end of the first link to linearly move the platform in a direction along the central axis; and a rocker assembly mounted to one of the plurality of flexures and including a flexible cable mounted to the second link to provide a movement of the cable corresponding to the pivoting of the second link to rotate the platform.

6. The environmental transition system of claim 1 wherein the actuator comprises:

a drive gear;

a gear wheel engaging the drive gear and oriented to rotate about a first rotational axis in response to a rotation of the drive gear;

a link having a first end pivotally coupled to the platform, and having a second end pivotally coupled to the gear wheel at a point offset from the rotational axis for linearly translating the platform in a direction along the central axis in response to rotation of the gear wheel;

a cam disposed to rotate with the gear wheel; and a cam follower engaging the cam and coupled to one of the plurality of flexures to rotate the platform about the central axis in response to rotation of the drive gear.

7. The environmental transition system of claim 6 wherein the relationship between gearing of the gear wheel and the cam is selected to provide a ratio of linear motion to rocking motion of approximately 2:1.

8. The environmental system of claim 6 wherein the first end of the link is pivotally coupled to the platform substantially along the central axis to reduce interaction between translational and rotational motions attributable to the link coupled to the platform.

9. The environmental system according to claim 6 wherein the drive gear is a worm gear mounted for rotation about a drive axis, and the gear wheel is a worm-following gear engaged with the worm gear to rotate about an axis substantially normal to the drive axis.

10. The environmental system of claim 1 wherein the base plate, the platform, the plurality of flexures, and the actuator are housed in a mattress.

11. The environmental system according to claim 10 comprising a mattress including a peripheral portion and a central movable portion, wherein said base plate and platform and actuator and flexures are disposed within the peripheral portion, and the platform supports the movable portion on said second surface.

12. The environmental system according to claim 11 in which said actuator is disposed between a flexure and the base plate to provide the translational and angular movements of the platform and the central portion of the mattress supported thereby relative to the peripheral portion of the mattress.

13. The environmental system of claim 10 including a peripheral portion of the mattress disposed to substantially surround the base plate, platform, flexures, and actuator, and including a movable portion of the mattress positioned on the platform for translational and rotational movement of the movable portion relative to the peripheral portion.

14. The environmental system of claim 13 in which the peripheral portion of the mattress includes upper perimeter surfaces, and in which the movable portion of the mattress includes peripheral edges extending outwardly from the platform to substantially overlap the upper perimeter surfaces of the peripheral portion of the mattress.

15. The environmental system of claim 14 in which the upper perimeter surfaces of the peripheral portion of the mattress are tapered downwardly in an inward direction, and in which underside surfaces of the peripheral edges of the movable portion of the mattress are tapered in thickness in the outward direction in substantially mating relationship with the tapered upper perimeter surfaces of the peripheral portion of the mattress.

16. The environmental system of claim 14 including a layer of material interposed between the upper perimeter surfaces of the peripheral portions of the mattress and adjacent overlapping surface portions of the movable portion of the mattress to reduce force required to move the movable portion of the mattress relative to the peripheral portion of the mattress.

17. The environmental system of claim 14 wherein the movable portion of the mattress includes regions of reduced thickness near the peripheral edges to promote flexible conformance of the overlapping peripheral edges with the upper perimeter surfaces of the peripheral portions of the mattress.

18. The environmental system of claim 1 wherein each of the plurality of flexures includes centrally oriented compliant sections to provide flexibility about the longitudinal axis to provide for angular displacement of the platform.

19. The environmental system of claim 1 wherein each of the plurality of flexures includes compliant sections laterally spaced from the central axis to provide flexibility in a direction along the longitudinal axis and including a second flexure near each of opposite ends of the flexure having compliant sections to provide flexing in a direction substantially perpendicular to the longitudinal axis during the translation of the platform in a direction along the longitudinal axis.

20. The environemental system of claim 1 wherein the actuator is hydraulically driven.

21. The environmental system of claim 1 comprising a sensor disposed with respect to the actuator to sense motion of the actuator that translates or rotates the platform.

22. The environmental system of claim 21 comprising:

counter means connected to the sensor to accumulate a count of the number of operating cycles of translational and rotational motions of the platform.

23. The environmental system according to claim 21 in which the sensor is operatively connected to inhibit translation and rotation of the platform in response to detection thereby of a selected operating condition of speed and repetitions of the platform exceeding a determined limit.

24. The environmental system according to claim 21 including alarm means activated to provide an output indication in response to detection of a selected operating condition of speed and repetitions of the platform exceeding a determined limit.

25. The environmental system according to claim 21 in which the sensor is operatively coupled to the actuator for selectively stopping motion of the movable platform at approximately horizontal orientation thereof.

26. An environmental transition system comprising:

a peripheral portion of a stationary mattress, and a movable portion mounted within the peripheral portion of the stationary mattress for combined translational and rotational movements relative to the peripheral portion, the peripheral portion of the mattress including upper perimeter surfaces, and the movable portion of the mattress including peripheral edges extending outwardly from the platform to substantially overlap the upper perimeter surfaces of the peripheral portion of the mattress;

a mount for the moving portion of the mattress including supporting flexures; and an actuator coupled thereto for moving the movable portion of the mattress through determined translational and rotational movements relative to the peripheral portion;

said upper perimeter surfaces of the peripheral portion of the mattress being tapered downwardly in an inward direction, and in which underside surfaces of the peripheral edges of the removable portion of the mattress are tapered in thickness in an outward direction in substantially mating relationship with the tapered upper perimeter surfaces of the peripheral portion of the mattress.

27. The environmental transition system of claim 26 wherein the movable portion of the mattress includes regions of reduced thickness near the peripheral edges to promote flexible conformance of the overlapping peripheral edges with the upper perimeter surfaces of the peripheral portions of the mattress.

28. An environmental transition system comprising:

a peripheral portion of a stationary mattress, and a movable portion mounted within the peripheral portion of the stationary mattress for combined translational and rotational movements relative to the peripheral portion, the peripheral portion of the mattress including upper perimeter surfaces, and the movable portion of the mattress including peripheral edges extending outwardly from the platform to substantially overlap the upper perimeter surfaces of the peripheral portion of the mattress;

a mount for the moving portion of the mattress including supporting flexures; and an actuator coupled thereto for moving the movable portion of the mattress through determined translational and rotational movements relative to the peripheral portion; and a layer of material interposed between the upper perimeter surfaces of the peripheral portions of the mattress and adjacent overlapping surface portions of the movable portion of the mattress to reduce force required to move the movable portion of the mattress relative to the peripheral portion of the mattress.

* * * * *